United States Patent [19]

Dubois et al.

[11] 4,002,021

[45] Jan. 11, 1977

[54] ROTARY ESCAPEMENT FOR TIMEPIECE

[75] Inventors: Roland Dubois; Alexandre Antoine Bernasconi, both of Le Locle, Switzerland

[73] Assignee: Les Fabriques d'Assortiments Reunies, Le Locle, Switzerland

[22] Filed: Oct. 31, 1975

[21] Appl. No.: 627,909

[30] Foreign Application Priority Data

Nov. 2, 1974 Switzerland ..... 14651/74

[52] U.S. Cl. ..... 58/117; 58/116 M

[51] Int. Cl.² ..... G04B 15/14

[58] Field of Search ..... 58/107, 116 R, 116 M, 58/117, 119, 123

[56] References Cited

UNITED STATES PATENTS

| | | | |
|---|---|---|---|
| 1,106,253 | 8/1914 | Thiel | 58/116 R |
| 2,725,716 | 12/1955 | Varaud | 58/119 |
| 3,505,805 | 4/1970 | Cohen et al. | 58/116 R X |
| 3,538,851 | 11/1970 | Korr | 58/117 X |
| 3,681,915 | 8/1972 | Kanazawa et al. | 58/117 X |

FOREIGN PATENTS OR APPLICATIONS

| | | | |
|---|---|---|---|
| 58,715 | 1/1912 | Switzerland | 58/117 |
| 70,646 | 5/1914 | Switzerland | 58/116 R |
| 105,032 | 6/1924 | Switzerland | 58/116 R |

*Primary Examiner*—Stanley J. Witkowski
*Attorney, Agent, or Firm*—Karl F. Ross; Herbert Dubno

[57] ABSTRACT

A timepiece escapement has a balance carrying an eccentric pallet pin periodically and regularly oscillating forward and backward about a balance axis with the pin engaging on each forward oscillation between the teeth of an adjacent escape wheel so as angularly to step this escape wheel. The pin is engageable with the escape wheel through a predetermined lift angle which is equal to less than half of the engagement angle during which the pin is within the orbit of the teeth of the escape wheel and, therefore, prevents this wheel from rotating independently of the balance.

6 Claims, 6 Drawing Figures

ROTARY ESCAPEMENT FOR TIMEPIECE

FIELD OF THE INVENTION

The present invention relates to an escapement mechanism for a timepiece. More particularly this invention concerns a rotary balance-type escapement such as is used in an electrically powered watch.

BACKGROUND OF THE INVENTION

The rotary-type escapement for a watch or the like usually has a rotary balance carrying an eccentric pallet pin that is periodically and regularly oscillated forward and backward about a balance axis. As the balance oscillates its pallet pin engages on each forward oscillation between the teeth of an adjacent escape wheel rotatable about a respective wheel axis and displaces this wheel angularly one step. The teeth and pallet pin are shaped so that on reverse displacement of the pallet pin the escape wheel is moved backwardly to a minor extent insufficient to cancel the forward displacement of the escape wheel. A magnet or similar retaining device is provided to hold the escape wheel in position between forward oscillations of the balance.

The pallet pin is therefore oscillated back and forth through an arc. In only a portion of this arc, having an angular width equal to the so-called lift angle, does the pallet pin on forward oscillation engage against and displace the escape wheel. The overall oscillation angle is, however, considerably longer than the lift angle. Furthermore, the pallet pin only engages within the orbit of the outer ends of the teeth of the escape wheel during displacement through the so-called engagement angle. Within this engagement angle displacement of the escape wheel independently of the balance wheel is almost impossible, as the teeth would strike the pallet pin and their displacement would thereby be limited.

The principal problem with such escapements which are otherwise known for their simplicity and low manufacturing cost is that it is frequently possible for the escape wheel to advance more than one step for each forward oscillation of the pallet pin. This happens particularly in wrist watches which are subjected to occasional shocks that allow the escape wheel to rotate through several angular steps when the pallet pin is at the end of its travel and outside the engagement angle, that is lying outside the orbit of the teeth. This extra stepping most commonly occurs when the wrist watch is subjected to a shock at or shortly after the instant when during forward oscillation the pallet pin strikes the tooth of the escape wheel.

OBJECTS OF THE INVENTION

It is therefore an object of the present invention to provide an improved timepiece escapement.

Another object is the provision of an escapement for a watch or the like which is not subject as described above to false stepping.

SUMMARY OF THE INVENTION

These objects are attained according to the present invention in a timepiece escapement as described above wherein the engagement angle is at least twice as great as the lift angle. Thus in accordance with the present invention the possibility of the escape wheel falsely stepping is largely eliminated because the pallet pin remains engaged within the escape wheel even after the lift when it has stepped the escape wheel so that this escape wheel then has sufficient time to be arrested before the pallet pin disengages and leaves it in a position where potentially it could be advanced an extra angular step.

According to further features of this invention detent means is provided to retain the escape wheel in any of a plurality of positions each corresponding to one step of the escape wheel. This detent means may comprise in accordance with this invention a small magnet in line with the successively passing teeth of the escape wheel and serving magnetically to attract a tooth and hold the escape wheel generally nonrotatively.

BRIEF DESCRIPTION OF THE DRAWING

The above and other features, objects, and advantages will become more readily apparent from the following, reference being made to the accompanying drawing in which.

SPECIFIC DESCRIPTION

Figure 1:
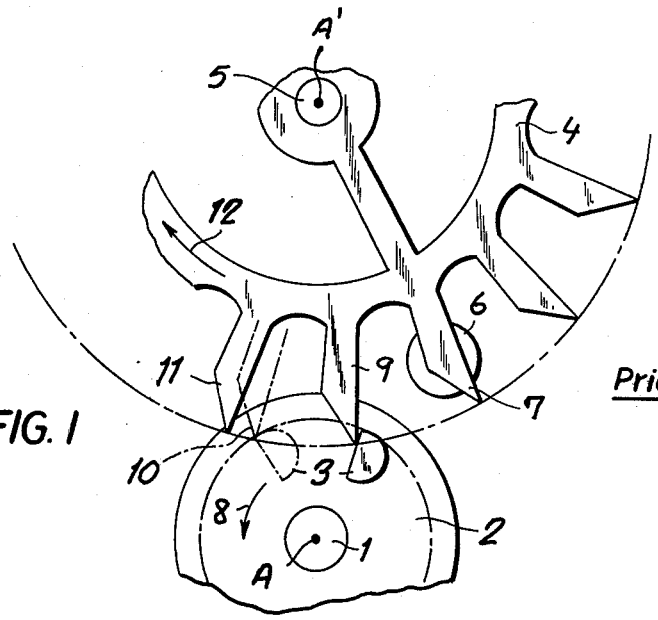
FIG. 1 Prior Art
FIGS. 1 and 2 are top views illustrating a prior-art escapement in successive positions.
Figure 2:
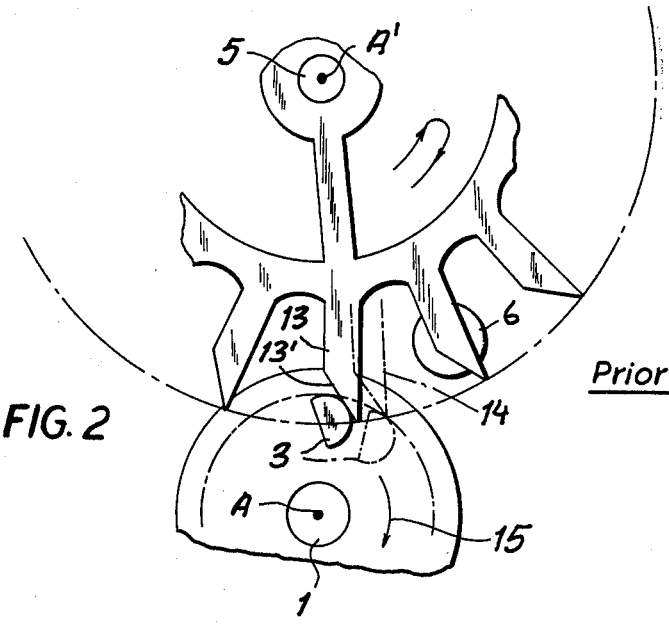
FIG. 2 Prior Art

As shown in FIGS. 1 and 2 in a prior-art escapement a balance has a pivot pin 1 defining a balance axis A and carrying a disk 2 on which is mounted a gudgeon or pallet pin 3 extending parallel to the axis A and of semicylindrical shape, with its flat face turned in a forward direction and in line with the axis A. In addition the escapement has an escape wheel 4 mounted on a pin 5 defining an axis A′ parallel to the axis A, and has teeth such as indicated at 9.

Drive mechanism drives the balance disk 2 so as to oscillate the pallet pin 3 forward in the direction of arrow 8 (FIG. 1) and backward in the direction of arrow 15 (FIG. 2). A magnet 6 serves to attract one of the teeth as shown at 7 and hold the wheel 4 in any of a plurality of angularly equispaced positions.

As is well known in the prior art during forward rotation (arrow 8 in FIG. 1) the flat face of the pin 3 presses against the back of the tooth 9 and advances it through a lift displacement to the position indicated at 10 in FIG. 1. At this instant the pin 3 moves out of engagement with the tooth but the magnet 6 serves to pull the next tooth into a position directly over it, thereby positioning tooth 9 at 11 in FIG. 1. This rotates the balance wheel 4 one step in the direction of arrow 12.

On return oscillation the pin 3 strikes with its rounded back surface the inclined face 13′ of the tooth 13. This action displaces the tooth 13 back slightly as indicated at 14 in FIG. 2, but not sufficiently to index the wheel 4 backwardly. As soon as the pin 3 while moving in the direction of arrow 15 comes out of engagement with the pin 13, that is in the position 14, the magnet 16 pulls the pin 13 back to its original position.

The principal disadvantage of this prior-art system illustrated in FIGS. 1 and 2 is that when the pin 3 strikes the tooth 9 there is produced an elastic shock which is transmitted from the pin 3 to the wheel 4. Since this wheel 4 has very small inertia it is possible that the tooth 9 will gain a speed which is substantially higher than that of the pin 3 and move ahead of it. For this reason it is not impossible that when position 10 is reached the wheel has sufficient inertia to overcome the force of the magnet 6 and continue rotating through two or even three more steps. This typically happens when the balance, under the effect of an external shock, has received an extra impulse. It has been suggested to overcome this disadvantage by increasing the strength of the magnet 6. This, however, has the disadvantage that it is necessary to use a substantially stronger spring or motor to drive the watch, and friction and other wear problems are greatly increased.

Figure 3:
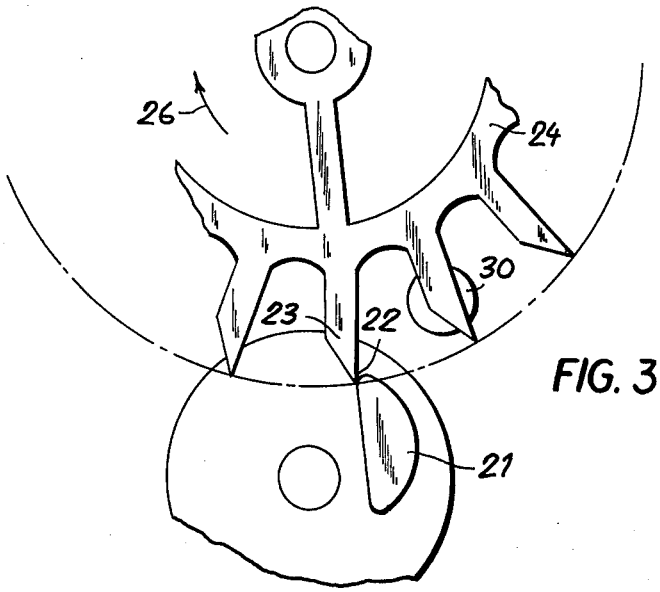
FIGS. 3 and 4 are views similar to FIGS. 1 and 2 illustrating the escapement in accordance with this invention.
Figure 4:
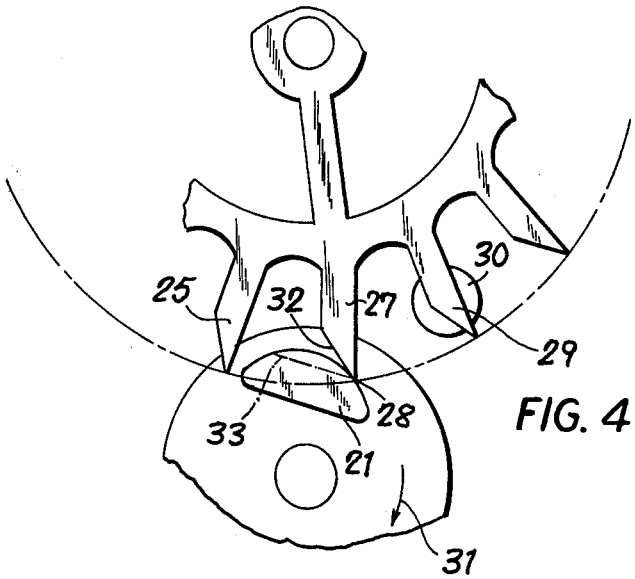

FIGS. 3 and 4 show how the apparatus according to the instant invention overcomes these disadvantages.

Here the pin 21 strikes the tooth 23 with its rounded edge. The escape wheel 24 thereby is accelerated in the direction of arrow 26 and the tooth 23 can indeed at this instant move ahead of the pin 21. However, it cannot move ahead by more than one step because, as shown in FIG. 4, the following tooth 27 will strike the back of the pin 21 so as to stop the wheel 24 and place the tooth 29 in the field of the magnetic plug 30.

On return stroke, as the pin 21 is displaced backwardly in the direction of arrow 31, the impulse communicated to the wheel 24 by the pin 21 is substantially weak, as the forward face 32 of the tooth is inclined to a plane through the rotation axis of the respective wheel and the back surface 28 of the pin 21 is rounded cylindrically.

In order to allow adjustment of this system the back face 28 of the pin 21 may be made planar as indicated at 33 and given a reflective coating. This arrangement allows easy calibration of the system by means of light-receiving devices.

Figure 5:
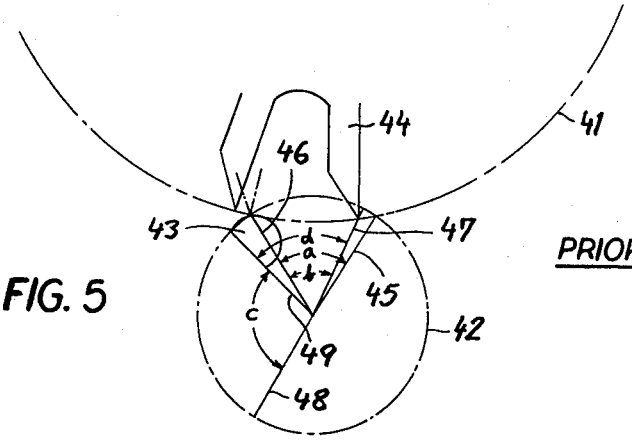
FIG. 5 PRIOR ART
FIG. 5 is another view illustrating the prior-art type of escapement.
Figure 6:
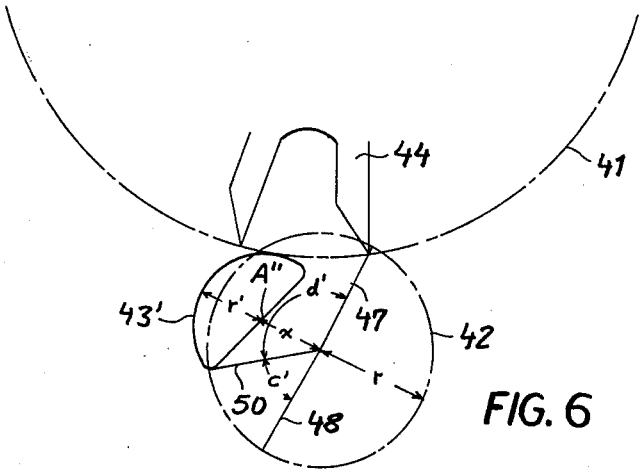
FIG. 6 is a view similar to FIG. 5 illustrating the escapement in accordance with the present invention.

FIGS. 5 and 6 show in more detail a prior-art escapement (FIG. 5) compared with an escapement according to the present invention (FIG. 6). The escape wheel 44 defines an orbit 41 and the pin 43 and orbit 42. These orbits 41 and 42 intersect along radii 45 and 46 passing through the center of the orbit 42 and defining an angle *a*. The so-called lift angle *b* is defined between radii 46 and 47, the pin 43 being able to advance the wheel 44 as it is displaced forwardly between these two positions. The free-travel angle *c* of the balance is defined between radii 49 and 48. The engagement angle *d* of the pin 43 in the teeth 44 is between 47 and 49.

The engagement angle *d* of the pin 43 in the wheel 44 is in the prior-art system of FIG. 5 only slightly greater than the lift angle *b*. It is easy to see that during the entire engagement angle *d* the wheel 44 is prevented from rotating by the pin 43 which is engaged between its teeth so that it is impossible for the wheel to make an extra step. However during displacement through the free-travel angle *c*, which is substantially greater than the angles *a*, *b*, or *d* it is entirely possible for the wheel 44 to rotate freely.

With the system according to the present invention as illustrated in FIG. 6 a pin 43' is used which is of semi-cylindrical shape and of a diameter greater than the radius of the orbit 42. This gives an engagement angle *d'* which is more than twice as great as the lift angle, *b*, leaving a free-travel angle *c'* between the radii 50 and 48 which is relatively small. Thus it is almost impossible to false-step the wheel 44 with the system according to this invention.

In the arrangement of FIG. 5 angle *a*, equal to the overlap of orbits 41 and 42, is 69°. The lift angle *b* is equal to 61°. The free-travel angle *c* is 116° and the engagement angle *d* is 74°.

In FIG. 6 the free-travel angle *c'* is reduced to 48°. Correspondingly the engagement angle *d'* is increased to 130°. Angles *a* and *b* are the same in FIG. 6 as in FIG. 5. The orbit 42 has a radius *r* equal to between 1.5 and 2 times *r'*, which is the radius of the semi-cylindrical pin 43'. The distance *x* between the pin center of curvature A'' is equal to between one-third and two-thirds *r*.

I claim:

1. In a timepiece escapement wherein a balance carrying an eccentric pallet pin periodically and regularly oscillates forward and backward about a balance axis with the pin engaging on each forward oscillation between the teeth of an adjacent escape wheel rotatable about a parallel wheel axis to displace said wheel only during said forward oscillation about said balance axis through a predetermined lift angle centered on said balance axis, said pallet pin being engaged within the orbit defined by said teeth and substantially preventing rotation of said wheel independent of said balance during forward and backward oscillation of said balance through a predetermined engagement angle at least partially overlapping said lift angle, the improvement wherein said engagement angle is at least twice as great as said lift angle.

2. The improvement defined in claim 1 wherein said escapement further comprises detent means nondisplaceable relative to said axes for retaining said wheel between said forward oscillations at any of a plurality of equiangularly offset positions.

3. The improvement defined in claim 2 wherein said detent means includes a magnet adjacent the teeth of said wheel.

4. The improvement defined in claim 2 wherein said pin is generally parallel to said axes and has a part-cylindrical surface engageable with said teeth.

5. The improvement defined in claim 4 wherein said pin defines on oscillation a pin orbit and said surface has a radius of curvature equal to between one-third and two-thirds the radius of said pin orbit.

6. The improvement defined in claim 4 wherein said surface has a planar back face.

* * * * *